US006411569B1

(12) United States Patent
Megner et al.

(10) Patent No.: US 6,411,569 B1
(45) Date of Patent: Jun. 25, 2002

(54) ANTENNA ARRANGEMENT IN RADIO-CONTROLLED WRISTWATCH

(75) Inventors: Günter Megner, Uhldingen; Rüdiger Daut, Schramberg, both of (DE)

(73) Assignee: Junghans Uhren GmbH, Schramberg (DE)

( * ) Notice: Subject to any disclaimer, the term of this patent is extended or adjusted under 35 U.S.C. 154(b) by 30 days.

(21) Appl. No.: 09/587,981

(22) Filed: Jun. 6, 2000

(30) Foreign Application Priority Data

Jun. 9, 1999 (DE) ..... 199 26 271

(51) Int. Cl.[7] ..... G04C 3/00
(52) U.S. Cl. ..... 368/43; 368/10; 368/281
(58) Field of Search ..... 364/10, 43

(56) References Cited

U.S. PATENT DOCUMENTS 4,232,512 A * 11/1980 Yoshikawa et al. ..... 368/82
5,144,599 A 9/1992 Blaich et al.

FOREIGN PATENT DOCUMENTS

DE 29607 866 U1 9/1997
EP 0 896 262 2/1999

* cited by examiner

*Primary Examiner*—Bernard Roskoski
(74) *Attorney, Agent, or Firm*—Burns, Doane, Swecker & Mathis, LLP

(57) ABSTRACT

A radio-controlled wristwatch includes a casing. A central portion of the casing disposed generally centrally with reference to a longitudinal center axis of the casing is formed of metal at least on the exterior thereof. An antenna core is disposed within a chamber defined by the casing. The antenna core lies on a plane oriented transversely with respect to the longitudinal axis. A spacer ring is disposed in the chamber between the central portion and the antenna core, the spacer ring formed of electrically non-conductive material.

15 Claims, 2 Drawing Sheets

ANTENNA ARRANGEMENT IN RADIO-CONTROLLED WRISTWATCH

BACKGROUND OF THE INVENTION

The invention concerns a radio-controlled wristwatch which includes a magnetic longwave antenna received in the wristwatch casing.

A radio-controlled wristwatch of that kind, as is described for example in EP 0 896 262 A1 (corresponding to U.S. Ser. No. 09/131,668, the disclosure of which being incorporated herein by reference), has proven itself in practice. It is distinguished by virtue of its works being of an extremely compact structure because the ferrite bar antenna is flexible (i.e. formed of laminated plates) and follows (i.e., is parallel to) the inside contour of the casing, and is integrated into the printed circuit board with the processor for the electronic receiving, decoding and timing circuits. It will be noted however that a structure of that kind requires a non-metallic timepiece casing because otherwise the proximity of the metal to the antenna means that the antenna function would be impaired, to such an extent as to be inoperable, not only as a consequence of mistuning but in particular also as a consequence of quality losses which cannot be compensated by subsequent tuning.

If however for aesthetic reasons a metal timepiece casing is wanted, then the magnetic longwave antenna for receiving the encoded time information has to be moved to a position outside the casing, that is to say into the strap or bracelet of the wristwatch, as is described in greater detail for example in U.S. Pat. No. 5,144,599 (the disclosure of which being incorporated herein by reference). Such a structure developed as the standard almost a decade ago. It however suffers from the fundamental disadvantages that, by virtue of the fact of the wristwatch being worn on the wrist, there exists a serious risk of accelerated wear occurring at the place where the strap or bracelet abuts against the casing (because of the requirement for a flexible introduction of the antenna line) and also at the strap or bracelet itself (because of the admittedly flexible but nonetheless non-negligible foreign body in the form of the laminated ferrite antenna in the tubular strap or bracelet).

The object of the present invention is therefore that of combining the advantages of the previously known radio-controlled wristwatches having a plastic casing and an integrated antenna on the one hand, and radio controlled wristwatches with a metal casing and an external antenna on the other hand, which opens a new wide range of designs of high-quality timepieces with a high degree of comfort in terms of wearing the timepiece and a low level of susceptibility to trouble.

SUMMARY OF THE INVENTION

In accordance with the invention that object is essentially attained in that the radio-controlled wristwatch has a metal central portion in the region situated between the timepiece glass and an electrically non-conducting bottom, wherein a ferrite bar antenna is installed over its entire length at a not-inconsiderable radial spacing from the inside wall of the timepiece casing towards the center thereof.

For the case which is to be preferred for design construction reasons, where the magnetic longwave antenna is again arranged on the printed circuit board at the edge of the timepiece works, to ensure radial spacing in all directions of the antenna core relative to the inside wall of the electrically conducting central portion of the casing, a spacer ring injection-molded from plastic material is desirably fitted into the central portion of the casing, the spacer ring in turn serving in the center as a receiving ring for the works equipped with the ferrite bar. In that case, the expensive configuration of a laminated core which is fitted in a curved condition does not need to be selected for the ferrite bar, it is sufficient to install an inexpensive rigid prismatic bar along a secant relative to the periphery of the timepiece works, preferably with inclined ground-off ends, the bar being as long as possible to fit snugly in shape-locking relationship into the correspondingly recessed internal periphery of the spacer ring.

The non-metal bottom of the timepiece casing can comprise plastic or glass material. Glass may be preferable, because the surface of the glass which bears against the wrist is found to be extremely sympathetic and completely allergy-free in relation to the skin. If there is no wish to have the option of looking into the wristwatch works in the manner of a skeleton-type timepiece, as would be the case if the glass bottom were transparent, then the inside of the bottom glass can be provided with a non-metallic vapor deposition and thereby rendered opaque. In that case, in the course of the vapor deposition procedure, the bottom could be provided with an ornamental configuration, for example by means of figurative stencils; or the deposit could then be processed to afford a figurative configuration, by laser erosion (which produces processing tracks burnt black in the deposit, and which can also be effected subsequently from the exterior through the glass of the bottom when already fitted in place).

BRIEF DESCRIPTION OF THE DRAWINGS

Additional features, developments and advantages of the invention will be apparent from the further claims and from the following description of a preferred embodiment of the structure according to the invention, which is diagrammatically shown in greatly simplified form in the drawing, being limited to what is essential, without being true to scale.

DETAILED DESCRIPTION OF PREFERRED EMBODIMENTS OF THE INVENTION

Figure 1:
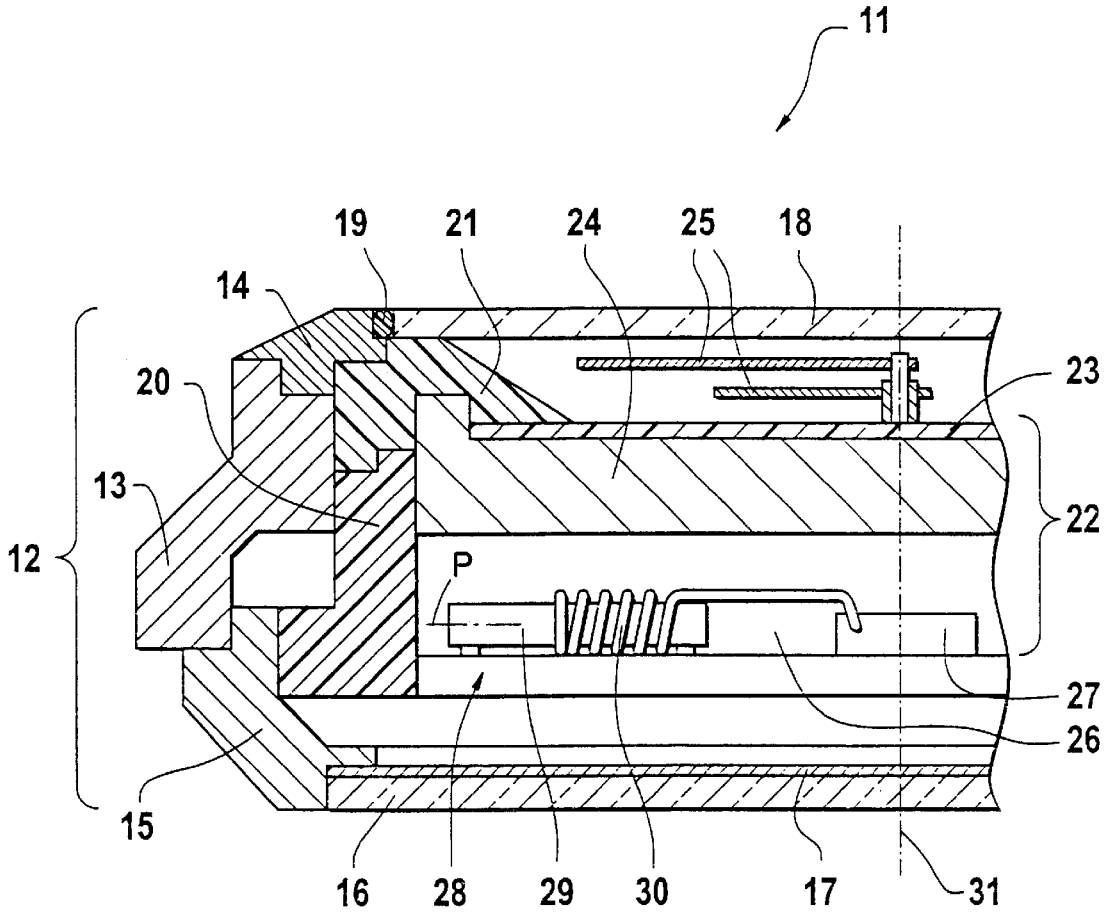
FIG. 1 is a view in longitudinal axial section of the structure according to a first embodiment of a radio-controlled wristwatch with a magnetic longwave antenna integrated into a metal wristwatch casing, for the reception of encoded time information.

The radio-controlled wristwatch 11 which is diagrammatically illustrated in a longitudinal axial section in FIG. 1 has a casing 12 with a central portion En 13 of electrically conducting material. This may be a solid but nonetheless radially thin high-quality steel or titanium ring.

Figure 2:
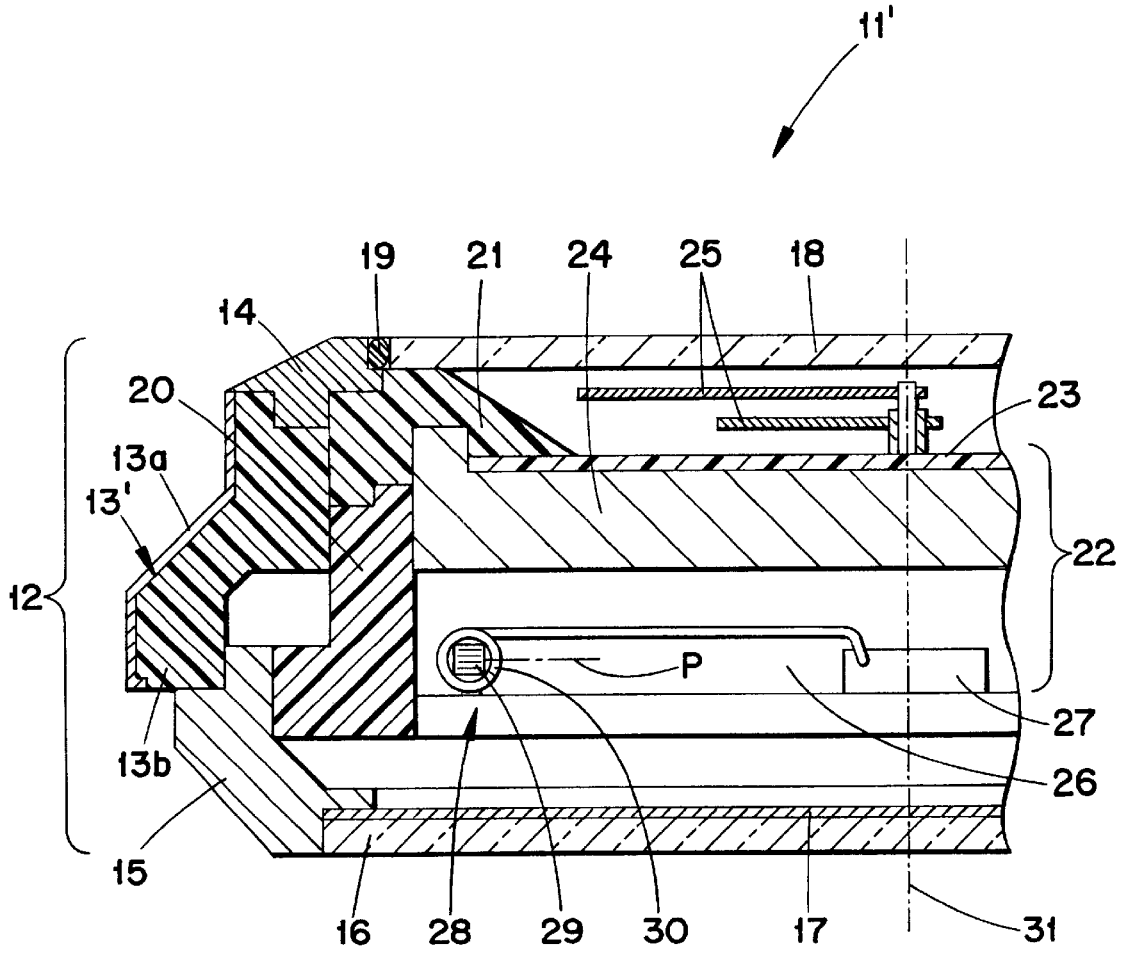
FIG. 2 is a view similar to FIG. 1 of a second embodiment of the wristwatch.

Alternatively, as shown in the wristwatch 11' of FIG. 2, the central portion 13' could comprise a non-metallic inner portion 13*b* (e.g. injection molded plastic) having a metallic outer shell 13*a*.

This metallic portion 13 (or 13*a*) screens-out interference influences which can otherwise be coupled in, from a laterally connected metal-link bracelet to the radio-controlled wristwatch antenna which is received in the wristwatch casing. If the central portion 13 is not formed integrally with a top ring 14 and/or a bottom ring 15, but, rather as diagrammatically illustrated, the rings 14, 15 are in the form of separately produced members attached to the central portion 13 of the casing, then the members 14, 15 could comprise a material (possibly also electrically conducting) which is different than the preferably steel central portion 13. If the rings 14, 15 are electrically conducting, they should not project radially substantially beyond the central portion 13 towards the center axis 31 of the casing 12 of the wristwatch.

The bottom plate 16 comprises a stiff plate of electrically nonconducting material, in particular ceramic or glass, which is force fit into a rear end of the casing 12. The plate 16 carries, on a side thereof facing towards the interior of the housing, a covering or coating 17 which is visible through the glass bottom 16 and which can have a decorative or informative appearance. In opposite relationship thereto the wristwatch glass 18 is fitted into a front end of the casing 12 in conventional manner by means of a sealing ring 19.

Arranged in the interior chamber of the casing 12 is a spacer ring 20 of electrically non-conducting material, in particular a plastic injection molding, which extends substantially farther than the rings 14,15 towards the center axis 31 of the housing 12. The ring 20 can be formed integrally with an arena-like face or dial ring 21. Alternatively, the ring 21 can be made separately from the ring 20 and of a different material and, as diagrammatically illustrated, applied to the side of the end face of the spacer ring 20, which is visible through the glass 18. The drawing does not show that the ring 20 can be provided with radial bores for receiving sleeves in which pushrods passing through the central portion 13 of the casing are water-tightly guided for actuating switching-over procedures in the radio-controlled wristwatch mechanism 22.

The spacer ring 20 which is held in the casing 12 serves directly and/or by means of its face or dial ring 21 as a works ring, that is to say for holding the wristwatch works 22 in the casing 12. The edge of the face or dial 23 which is mounted on the visible side of the wristwatch works 22 and which comprises electrically, non-conducting material has the face ring 21 engaging radially thereover, whereby it is concealed i.e., non-visible through the glass 18. The wristwatch works essentially comprises a gear mechanism 24 for movement of the hands 25 and an electronic block 26 for, on the one hand, drive control and, on the other hand, for the reception and decoding of encoded time information for periodically checking and if necessary correcting the position of the hands. For that purpose the electronic block 26 includes a longwave receiver 27 which is fixedly tuned to a time transmitter such as that which in Germany transmits the legal time (DCF 77). The receiver 27 is connected to a magnetic longwave antenna 28 in the form of a coil 30 through which a ferrite core 29 passes, as is diagrammatically shown in the drawing.

If the antenna 28 were arranged in the immediate proximity of the metal casing 12, then, as already mentioned above, not only would there be a (basically compensatable) resonance detuning effect, but in particular there would also be such a (non-compensatable) reduction in quality that, even with a very sensitive receiver 27, it would no longer be possible to reckon on useful reception conditions. Therefore, the interposition of the spacer ring 20 between the metal wristwatch casing 12 and the wristwatch works 22 provided with the antenna 28 ensures that the ferrite core 29 remains at a sufficient radial spacing from the interior of the metal casing 12, and is therefore displaced from the inside wall towards the longitudinal center axis 31 of the casing 12. As measured in the plane of the core 29, the width of the spacer ring 20 is typically of the order of magnitude of between 20% and 30% of the inside diameter of the wristwatch casing 12.

The antenna core 29 can be laminated, but if sufficiently spaced from the surrounding metal casing 12, a non-flexible prismatic, approximately cylindrical bar is also adequate for use as the antenna core. As diagrammatically illustrated in FIG. 1, the antenna can be mounted so as to extend radially in relation to the center axis 31 on the printed circuit board of the electronic block 26. The bottom plate extends radially outwardly from the axis 31 at least as far as the antenna core 30.

Alternatively, depending on the space requirements for the other electrical components the antenna could be arranged so as to extend at 90° relative to the plane of the figure e.g., tangentially to the radius in the form of a secant in the proximity of the outside periphery of the wristwatch works 22 as shown in FIG. 2.

Because of the antenna is disposed in a plane P oriented transversely relatively to the center axis 31 (which plane intersects the casing 12 at a location spaced from the glass top 18 and the bottom plate 16) the wristwatch is not subjected to an undue increase in height (thickness). Admittedly, with such an orientation of the antenna, no magnetic field lines which pass through the glass elements 18, 16 in parallel relationship with the central axis 31 would be able to pass into the core 29. However, because those field lines do not pass undisturbedly through the radiocontrolled wristwatch 11 but rather are distorted in regard to their propagation due to metal portions in the gear mechanism 24 and due to the surrounding metal central portion 13 of the casing, there is also a magnetic flux which is adequate for longwave reception through the preferably laminated core 29.

In the case of a radio-controlled wristwatch 11 according to the invention, it is not necessary on the one hand to forego a metal casing 12 and on the other hand there is no need for the magnetic longwave antenna 28 for reception of the time information to be decoded to be moved to a position outside the casing 12, such as in particular into a bracelet or strap. At least the central portion 13 of the casing is in the form of a thin solid (or coated) electrically conducting ring, within which a spacer ring 20 of electrically nonconducting material holds the wristwatch works 22 with an elongatedly prismatic antenna core 29 arranged in secant relationship at the edge thereof. The antenna 13 is disposed between two discs of electrically non-conducting material, more specifically the wristwatch glass 18 and the casing bottom 16, at a radial spacing from the metal central portion 13, wherein the bottom 16 is preferably a glass plate which is decoratively or informatively coated towards the interior of the casing.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A radio-controlled wristwatch comprising:

a casing defining a longitudinal center axis, and including front and rear ends spaced along the axis, at least an exterior surface of the casing formed of metal;

a bottom member formed of electrically non-conductive material and attached to the rear end of the casing;

a glass top attached to the front end of the casing and defining an interior chamber together with the casing and the bottom member;

a spacer ring of electrically non-conductive material arranged within the chamber coaxially with the casing; and an antenna core arranged in the chamber at a location spaced axially from the glass top and the bottom member and radially inwardly from the spacer member.

2. The radio-controlled wristwatch according to claim 1 wherein a plane oriented perpendicular to the chamber and containing the antenna core intersects the spacer member and the metallic exterior surface of the casing at respective locations spaced axially from the bottom member and the glass top.

3. The radio-controlled wristwatch according to claim 1 wherein the bottom member extends radially from the axis at least as far as the antenna core.

4. The radio-controlled wristwatch according to claim 1 further including a clockworks disposed in the chamber, the spacer ring situated radially between the clockworks and the center portion of the casing.

5. The radio-controlled wristwatch according to claim 1 wherein the antenna core is linear and extends radially with respect to the center axis.

6. The radio-controlled wristwatch according to claim 1 wherein the antenna core is linear and extends tangentially relative to a radius from the center axis.

7. The radio-controlled wristwatch according to claim 4 wherein the clockworks is carried by the spacer ring.

8. The radio-controlled wristwatch according to claim 2 wherein the portion of the casing intersected by the plane is solid metal.

9. The radio-controlled wristwatch according to claim 2 wherein the portion of the casing intersected by the plane comprises an inner electrically non-conductive material surrounded by a metallic shell.

10. The radio-controlled wristwatch according to claim 1 wherein the bottom member is formed of a ceramic material.

11. The radio-controlled wristwatch according to claim 1 wherein the bottom member is formed of glass.

12. The radio-controlled wristwatch according to claim 1 wherein the bottom member comprises a transparent electrically non-conducting material having a coating facing toward the antenna core.

13. The radio-controlled wristwatch according to claim 1 wherein the bottom member comprises a translucent electrically non-conductive material having a coating facing toward the antenna core.

14. The radio-controlled wristwatch according to claim 2 wherein the portion of the casing intersected by the plane includes steel.

15. The radio-controlled wristwatch according to claim 2 wherein the portion of the casing intersected by the plane includes titanium.

* * * * *